US007406920B2

(12) United States Patent
Scholz

(10) Patent No.: US 7,406,920 B2
(45) Date of Patent: Aug. 5, 2008

(54) SHELF SYSTEM FOR STORAGE AND FILING OF OBJECTS

(75) Inventor: Gottfried Scholz, Hofheim-Langehain (DE)

(73) Assignee: IREGA AG (CH)

( * ) Notice: Subject to any disclaimer, the term of this patent is extended or adjusted under 35 U.S.C. 154(b) by 432 days.

(21) Appl. No.: 10/491,043

(22) PCT Filed: Sep. 17, 2002

(86) PCT No.: PCT/EP02/10401

§ 371 (c)(1),
(2), (4) Date: Mar. 26, 2004

(87) PCT Pub. No.: WO03/028506

PCT Pub. Date: Apr. 10, 2003

(65) Prior Publication Data

US 2004/0237853 A1 Dec. 2, 2004

(30) Foreign Application Priority Data

Sep. 28, 2001 (DE) ..... 101 48 174
Dec. 8, 2001 (DE) ..... 101 60 364

(51) Int. Cl.
*A47B 9/00* (2006.01)

(52) U.S. Cl. ..... 108/107; 211/187

(58) Field of Classification Search ..... 108/107, 108/106, 110, 159, 187, 192, 193, 147.11, 108/147.12–17; 211/187, 135, 186
See application file for complete search history.

(56) References Cited

U.S. PATENT DOCUMENTS 1,871,972 A * 8/1932 Fenstermaker ..... 108/152
1,880,179 A * 9/1932 Onions ..... 108/107
2,090,353 A * 8/1937 Hokanson ..... 108/107
2,820,551 A * 1/1958 Mount ..... 108/107
3,199,471 A 8/1965 Orsi
3,306,466 A * 2/1967 Liston ..... 108/107
3,522,920 A * 8/1970 Gray et al. ..... 108/107
4,421,239 A * 12/1983 Vargo ..... 211/187
4,513,669 A * 4/1985 Steinke ..... 108/107
4,711,183 A * 12/1987 Handler et al. ..... 108/107
5,199,585 A * 4/1993 Schafer ..... 211/187
5,735,221 A * 4/1998 Benayon ..... 108/107

FOREIGN PATENT DOCUMENTS

| | | |
|---|---|---|
| DE | 11 78 564 | 9/1964 |
| FR | 2 516 770 | 11/1981 |
| FR | 2 484 806 | 12/1981 |
| GB | 422 661 | 1/1935 |
| WO | WO 02/35967 | 5/2002 |

* cited by examiner

*Primary Examiner*—José V Chen
(74) *Attorney, Agent, or Firm*—Robert W. Becker; Robert W. Becker & Ass

(57) ABSTRACT

A shelf system for the storage and filing of objects is provided. The system includes at least one shelf unit having a quadrilateral cross-sectional configuration. Vertical longitudinal posts are disposed at corners of the shelf unit. Horizontal crosspieces are disposable between two front ones of the posts. The crosspieces are provided with vertically and horizontally spaced apart, downwardly directed pairs of hooks. The posts are provided with recesses for receiving the hooks. Supporting boards are provided and each have a downwardly directed front flap that is adapted to be firmly wedged between a crosspiece and the posts that receive them to prevent lifting of the supporting boards.

23 Claims, 8 Drawing Sheets

SHELF SYSTEM FOR STORAGE AND FILING OF OBJECTS

BACKGROUND OF THE INVENTION

The invention relates to a shelf system for storage and filing of objects, essentially comprising at least one shelf with rectangular cross-section, at whose corner points vertical longitudinal poles are arranged, and between two front side longitudinal poles, horizontal girders or crosspieces for attaching supporting boards, provided with descending front side flaps, may be attached and the longitudinal poles have gaps for inserting vertically and horizontally distanced and descending pairs of hooks on said girders.

A large number of shelves, i.e. shelf systems, are known, whose individual components, such as longitudinal posts, lateral conductors, i.e. girders and supporting boards, are interconnected by different means of attachment. Such shelves normally feature several longitudinal posts at the shelf corner points, where, at certain vertical distances, one or more horizontal supporting boards are fixed, on which objects and/or bulk material is being stored. Additionally, it is often required to glue, weld or screw supporting boards with the longitudinal poles, and the type of fixation usually depends on the material from which the shelf has been manufactured.

It is disadvantageous with these shelves or shelf systems that contingent upon the type of connection, for example welding or gluing, these units no longer may be disassembled or adjusted to fit user requirements. As a consequence, these shelves, or shelf systems, evidence a high degree of stability, however a variation in size and number of supporting boards on the shelf, i.e. shelf system, is strongly restricted. Additionally, these shelves, or shelf systems, can only be transported with great difficulties, due to the volume required as a result of the fixed connection.

In addition, a number of connecting systems for shelves are known, where shelf components, such as supporting boards, longitudinal poles, girders, etc., may, for example, be interconnected by tongue and groove connections. In many systems, the supporting boards are simply applied on legs or pins at the girders. This procedure, however, results in a high degree of instability of the shelf system. Shelves or shelf systems, united by screws or special connecting elements, may be assembled or disassembled only with great effort, so that personnel specifically designed for this procedure face problems in assembling or disassembling. In addition, there is often a requirement for joining elements of complex format for connecting the supporting board, which are difficult to be produced from a viewpoint of technical production.

In the case of shelves or shelf systems, assembled merely based on an insertion process, these are usually screwed only with intercrossing struts, between diagonally opposed corner points on the rear side of the shelf. A longitudinal stability of the shelf is thus obtained. A certain lateral, i.e. depth stability is attained by girders which may be inserted into the longitudinal poles, and said girders compose lateral conductors with the longitudinal poles. The connection is usually made by means of screwjoints and gusset boards.

PCT/EP00/10857 describes a shelf system of the initially mentioned type, where each girder features pre-stressed insertion pockets, with an open upper section and, at the end section, a descending appendix is formed, which presents at least two vertically distanced hook-like structures. Supporting boards or insertion components of different configuration may be introduced into the storage pockets or insertion components, which are only being retained by the storage pockets in a self-clipping manner. For this purpose, the supporting boards feature high vertical front side flaps, in order to be able to insert them into the storage pockets, and the height of the front side flaps is contingent upon the depth of said storage pockets. The girder with the appendixes and storage pockets involve complex production features, resulting in high production cost figures. The high, vertical front side flaps of the supporting boards require a large amount of material, also as a result of additional folding flaps, in order to reinforce the front side flaps against buckling.

It is an object of the present invention to create a shelf system of the initially mentioned type for storage and filing of objects, which insures a high degree of stability and capacitance of the supporting boards with the girders.

SUMMARY OF THE INVENTION

According to the present invention, said objective is solved in that the descending front side flap of the supporting board is adapted to be jammed or clamped between the girder and its supporting longitudinal pole of the shelf.

Consequently, the front side flap will be firmly fixed directly between the girder and the longitudinal pole, so that any type of supporting boards may be jammed, which feature a front side flap. Storage pockets at the girders, as well as additional folding flaps at the corner sections of the supporting boards, are no longer required. This insures economy of material and production costs. The elimination of the storage pockets also renders possible the insertion of supporting boards of different depth and number. The connection of girder and longitudinal poles with reciprocal jamming of the front side flap of the supporting board provides high shelf, i.e. shelf system, stability, especially with a view to solid lateral stability. The supporting board is retained in a stable and firm manner, and is jammed against suspension, in view of the resulting shorter travel stroke of the retention. As a result of the relatively reduced height of the front side flap of the supporting board, also the supporting capacity of the supporting board and, consequently, of the shelf or shelf system, can be increased. This type of connection of longitudinal pole, girders and supporting boards is also advantageous vis-á-vis the reduction of the material strength and thickness of the supporting boards. This, in turn, renders possible a larger effective height and a larger useful volume in the area of the shelf system.

The shelf system is preferably structured according to a certain pattern, which determines the width, height and depth of the shelf, as well as the distances of the pairs of hooks of the girders and their corresponding insertion openings in the longitudinal poles.

According to a version of the invention, the girder features a supporting edge above the upper hooks, destined for the lower side of the supporting board and the free edge of the front side flap of the supporting board extends itself above the insertion points of the upper hooks of the girders in the longitudinal poles. Shorter travel strokes are thus obtained as well as pressure points of the supporting board, located close to the insertion points of the upper hooks. Consequently, the supporting board rests on the smooth supporting edge of the girder.

An economy of material and production costs for the supporting board is especially attained due to the fact that the height of the front side flap of the supporting board approximately corresponds to the distance between the supporting edge and the points of insertion of the upper girder hooks. Reduced heights of the front side flaps of the supporting boards are thus rendered possible.

Different forms of girder configurations for the shelf system are feasible, and girders may be used as roof-, intermediate- or bottom girders of a shelf.

According to one configuration of the girder, it consists of a basic structural component with pairs of upper and lower hooks. The girder may feature an additional support for the end segments of the longitudinal lateral walls of the supporting board. The longitudinal sides of the supporting board normally feature folded edges or closed channels to accept high loads. To provide an additional stabilization, their end sections rest on the additional support. Preferably, the support is simply folded from the basic foundation structure component. It forms a smooth, continuous leg and may receive folded edges of the supporting boards of variable width. Therefore, the supporting edge and the additional support in the form of a leg form a double rest for the supporting board.

Preferably, the additional support is featured horizontally, below the insertion points of the upper girder hooks, so that again shorter travel strokes and pressure points of the supporting board, located close to the hook insertion points, will be attained.

To further improve the stability of the suspension of the supporting boards and, additionally, the esthetic aspect of the shelf system according to the invention, the girder features, additionally, on the side in the direction of the longitudinal pole, an ascending, pocket-like folded edge, whose upper edge is located on a plane with the supporting edge for the supporting board. The front side of the supporting board is thus covered and in some measure optically closed. When several supporting boards are used, also their areas of transition will be covered, which, otherwise, always evidence unseemly cracks.

Furthermore, the additional folded edge may have a horizontal leg at its upper end to cover wholly or partially the upper front face of the longitudinal poles. With this measure, the upper open profile of the longitudinal poles of the shelf is closed, so that clefts or slots are invisible.

Additionally, the horizontal leg at the additional folded edge may be formed in such a fashion that it also covers the cleft between longitudinal poles of two adjacent shelves of the shelf system. It is also possible to use instead correspondingly adapted insertion components.

According to an improvement of the shelf system, the pocket-like ascendant folded edge of the girder is extended beyond its supporting edge. On one side, this renders possible a compartment division function for subdividing connected compartments in the shelf system. On the other side, the extended folded edge also accomplishes a retaining function for objects, such as, for example, document files and other plane and vertically stored objects, which are to be protected against overturning.

Also, the girder supporting edge may feature stamped sections of material or additional insert elements, for example bottom-like structures or gibs to cover the transition point of adjacent supporting boards, in order to improve the unseemly aspect and/or simultaneously raise the stability of the shelf system. Evidently, it is also feasible to use insert components instead.

The improved stability of the supporting boards retention will also be enhanced by the fact that said girder features a corrugation, in which at least the upper hooks are formed. Furthermore, the girder may have a reinforcing edge between the longitudinal poles. The fundamental girder structural component will thus become more stable.

In another configuration of said girder, this unit comprises a basic structural component with an articulate wall in the lower section and propped up at the basic structural component, thus forming a reception or insertion pocket for the supporting board front side flap of the supporting board. This girder is more simple in its configuration and construction, implying economy of costs and material. It is not adequate for so heavy loads as the girder earlier described, but for certain load requirements it is quite adequate on a sufficient level. The basic structural component and the articulate and notched wall form a double wall of the girder, with the lower section of the supporting board resting on the upper edge of the basic structural component and the front side flap of the supporting board will be jammed both between the basic structural component and the articulate wall and also between the lateral longitudinal poles of the shelf. An additional reinforcing bead or a similar device are not necessarily required. The double wall feature also renders possible to eliminate insert components or similar devices, in order to cover and protect the supporting board front side.

According to a further development of this girder, the basic structural component of the girder has upper and lower pairs of hooks and the wall, propped up against the basic structural component, has a lower pair of hooks. The latter are congruent and clinging to the lower pair of hooks in the basic structural component. The lower pairs of hooks of the basic structural component and the articulate wall at this component are in a closely adjacent position and penetrate into corresponding insert openings in the longitudinal poles of the shelf. The lower pair of hooks of the basic structural component transfixes the articulate wall, so that jamming of the basic structural component and wall at the longitudinal pole is insured.

Furthermore, the girder wall, propped up against the basic structural component, features releases above the lower pair of hooks, with liberation of the upper pair of hooks in the basic structural component. It is thus possible to dispense with the provision of a bead or the configuration of hooks with additional depth, since the front side flap of the supporting board, inserted between the basic structural component and the articulate wall offsets the distance of the wall, formed by the pair of hooks, corresponding to the thickness of the girder material. The releases in the corner sections of the wall render possible the insertion of the upper pair of hooks in the lateral longitudinal poles of the shelf.

In order to cover and protect the front side of the supporting board, the basic structural component of the girder has a height, which covers at least the front side flap of the supporting board.

To additionally stabilize the connection of the supporting board, girder and longitudinal pole of the shelf system according to the invention, the side of the girder, distant from the longitudinal pole, features cantilever elements for supporting end sections of the longitudinal side walls of the supporting boards, for example, the end sections of the longitudinal folded edges or channels. The supporting capacity of the supporting boards is thus increased.

The cantilever elements may also be separate structural components, preferably thrust blocks, which may be jointed with the girder. These separate structural components are screwed with the girder or are simply inserted only into orifices, for example, composing a series of orifices of the girder. In this fashion, the girder is additionally reinforced. Such thrust blocks, which, for example by means of the hooks formed thereon, may be suspended in the orifices of the series of orifices of the girder, are especially used when the shelf has extensive depth and/or when a large number of supporting boards in one plane and corresponding to a thrust block, are fastened in such a way at the girder, corresponding to a pattern, so that it supports two adjacent end sections of the side walls of two supporting boards or a very large supporting board between its side walls.

Similar as with the above described girder, the girder wall may embrace a horizontal leg at its upper end, which is designed to cover wholly or partially the upper front face of the longitudinal pole, so that additional insert components may be dispensed with. Additionally, other retention elements may be provided, which interconnect the cantilever elements, for example different thrust blocks, at a girder, so as to additionally increase the stability and supporting capacity of a deep shelf and to provide stabilization for said shelf.

To expand the possibility of utilization, the hooks of the above-described girders may feature different hook depths. This also renders possible to take into consideration different utilization purposes, production methods and material thicknesess of the girders and supporting boards.

Another advantageous configuration of the shelf system consists in that the basic structural component of the girder is formed in a descending extended fashion. Consequently, the basic structural component projects itself under the supporting board laterally inside the lower drawer.

As a result, the basic structural component may carry out the function of a drawer divider for subdividing interconnected drawers in the shelf system below the supporting board. On the other hand, the basic structural component, extended in a descendent direction, also carries out a retention function, for example for files and other spacious objects, which are protected in the lower drawer against dropping or falling over.

A special advantage of the shelf system according to the invention can also be seen in the fact that the girder consists of only one cut section, which can be manufactured at favorable cost with few production steps.

According to another configuration of the shelf system, the girder comprises a basic structural component with a wall thereto articulate on the lower section and propped up against said basic structural component, thus composing an insertion pocket for the front side flap of said supporting board, and the descending front side flap of said supporting board may be jammed between the girder insertion pocket, consisting of the basic structural component and of the wall propped up against it.

With this configuration of said girder, there is an economy in material and production costs. Consequently, the construction and production of said girder is more simple. The front side flap of said supporting board is jammed both between said basic structural component and the articulate wall, as well as at the lateral longitudinal poles of the shelf. It is also possible to jam the front side flap of the supporting board only between the basic structural component and the articulate wall.

According to another configuration of the invention, the basic structural component of the girder features a pair of upper hooks and a pair of lower hooks and the wall articulate at the basic structural component features congruent gaps in relation to said hooks. In the assembled state of the shelf, the upper and lower hooks of the basic structural component transfix the gaps in the wall propped up against said basic structural component.

In another configuration of said girder, the girder wall, propped up against the basic structural component, features releases in the upper and/or lower corner sections, freeing upper and lower hooks in said basic structural component. Especially the releases in the lower corners of the wall propped up against the basic structural component, render easier the production of said girder. The folded edge formed as a result of the articulation of said wall at the basic structural component, may thus be firmly compressed with an adequate pressing tool, without the pressing tool exerting influence over the hooks, formed at the basic structural component, with consequent damages.

According to another advantageous configuration of the present invention, said girder features at least one horizontal series of orifices for insertion of product supporting elements. The orifices of the series of orifices may be of square format. This will also result in a pleasant aesthetic design of said girder, which is further reinforced when, for example, two series of orifices are formed among themselves at the girder, with the series of orifices being disposed pursuant to a certain pattern.

It is understood that the above features, which will subsequently still be explained, may be used not only in the respective combination indicated, but also in other combinations or separately, without abandoning the context of the present invention.

BRIEF DESCRIPTION OF THE DRAWINGS

The fundamental idea of the present invention will be more closely described subsequently, based on exemplary embodiments shown in the figures. The figures show.

DESCRIPTION OF SPECIFIC EMBODIMENTS

Figure 1:
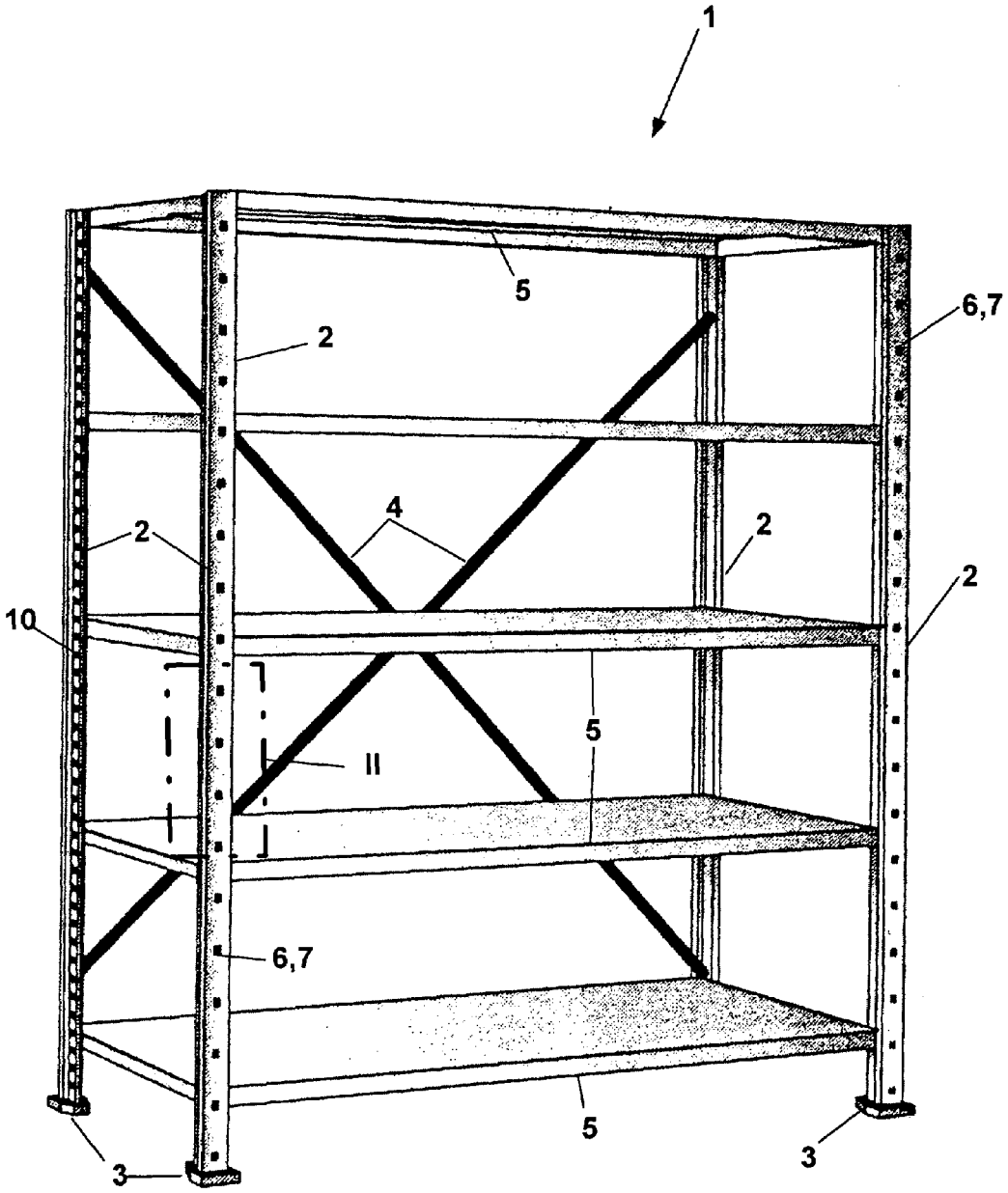
FIG. 1 perspective view of a shelf in the basic form of the shelf system according to the invention, FIG. 2 a partial front view 11 of a longitudinal pole of said shelf, according to FIG. 1, FIG. 3 a side view of the longitudinal pole according to FIG. 2, FIG. 4 a rear view of the longitudinal pole according to FIG. 2, FIG. 5 a cross-section view along line V-V of the longitudinal pole according to FIG. 4, FIG. 6 a perspective side view of a supporting board for a shelf, according to FIG. 1, FIG. 7 a perspective front side view of the supporting board according to FIG. 6, FIG. 8 a perspective front side view of the supporting board according to FIG. 6, in a modified configuration, FIG. 9 a schematic side view of a girder for a shelf, according to FIG. 1, in a first version, FIG. 10 a schematic side view of the girder according to FIG. 9, with supporting board applied, FIG. 11 a schematic side view of the girder according to FIG. 9 with supporting board applied and retention on a longitudinal pole, FIG. 11*a* an enlarged partial view of the upper section of the retaining connection according to FIG. 11, FIG. 12 a front view of the girder according to FIG. 9, FIG. 13 a schematic side view of a modified configuration of the girder according to FIG. 9, FIG. 14 a schematic side view of the girder element according to FIG. 13, with supporting board applied, FIG. 15 a schematic side view of the girder according to FIG. 13 with supporting board applied and retention on a longitudinal pole, FIG. 16 a schematic side view of another modified version of said girder, according to FIG. 9, FIG. 17 a schematic side view of the girder according to FIG. 16, with supporting board applied, FIG. 18 a schematic side view of the girder according to FIG. 16, with supporting board applied and retention on a longitudinal pole, FIG. 19 a schematic side view of a girder for a shelf according to FIG. 1, in a second version, FIG. 20 a schematic side view of the girder according to FIG. 19 with supporting board applied, FIG. 21 a schematic side view of the girder according to FIG. 19, with supporting board applied and retention on a longitudinal pole, FIG. 21*a* enlarged partial view of the upper section of the retaining connection according to FIG. 21, FIG. 22 a front view of the girder according to FIG. 19, FIG. 23 a schematic side view of a girder for a shelf system in another version, FIG. 24 a schematic side view of the girder, according to FIG. 23, with supporting board applied, FIG. 25 a schematic side view of the girder according to FIG. 23, with supporting board applied and retention on a longitudinal pole, FIG. 25*a* an enlarged partial view of the upper section of the retaining connection according to FIG. 25, FIG. 26 a front view of the girder according to FIG. 23, FIG. 27 a front view of the girder in another version and FIG. 28 a perspective front side view of the supporting board.
Figure 2:
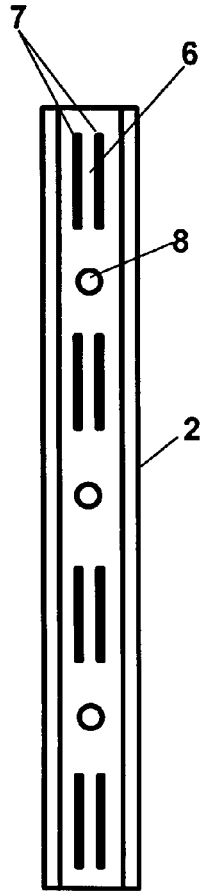
Figure 3:
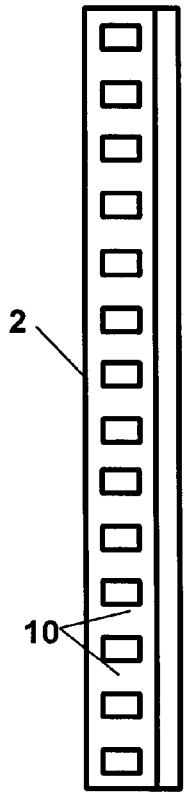

FIG. 1 shows a shelf I of a shelf system, which has a rectangular outline and is preferably comprised entirely of metal plate material. At each corner of the shelf I there is a vertical longitudinal post or pole 2 with a foot 3 at its lower end. Both rear longitudinal poles 2 are interconnected by means of two intercrossing and diagonally oriented struts 4, so that the shelf I has longitudinal stability.

In addition, the respective front side pairs of longitudinal poles 2 are interconnected by means of different horizontally distanced supporting boards 5, upon which objects (not shown) of all types may be placed. The upper supporting board 5 forms a top board, while the lower supporting board 5, observing a certain ground clearance, forms the bottom board.

FIGS. 2 to 5 show an enlarged view of area 11 according to FIG. 1 of a longitudinal pole 2. This features on its front side, according to FIG. 2, reciprocally distanced pairs of recesses or gaps 6, formed as slots 7. Insertion components, not shown, may be introduced in said slots 7, such as for example lining plates or special retentions for certain objects to be stored. In addition, reciprocally distanced perforations or holes 8 are provided. Another perforation or hole 9 is provided on the back side per FIG. 4, which is aligned towards perforation 8 on the front side of the longitudinal pole 2. These perforations 8 and 9 may be provided for screwing random components and/or retention of the longitudinal pole 2 on a wall.

In addition, the longitudinal pole 2 has on its lateral walls various reciprocally distanced recesses or gaps 10, which are essentially provided to reduce the weight of the longitudinal pole 2 by means of reduction of material, and also to receive components which will still be described.

Figure 4:
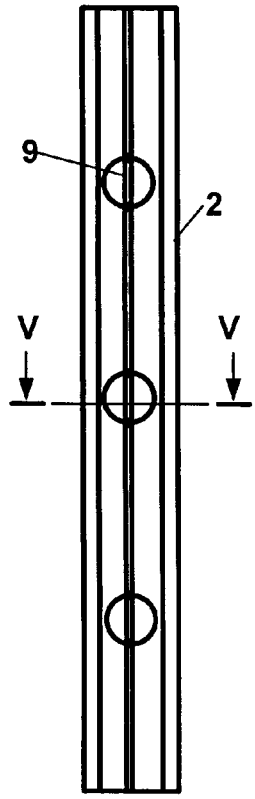
Figure 5:
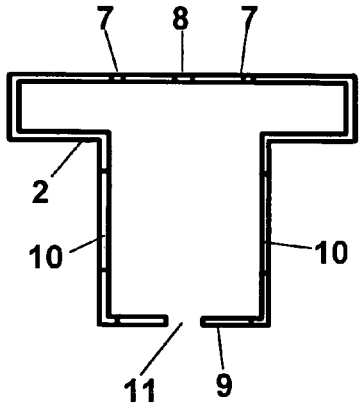

Furthermore, as can be seen in FIGS. 4 and 5, the longitudinal pole 2 may be formed as a hollow profile milled from flat plates, so that the finished longitudinal pole 2 forms a cleft or gap 11 on its rear side. Therefore, the longitudinal pole 2 has a cross-section, according to FIG. 5, essentially of a T.

Figure 6:
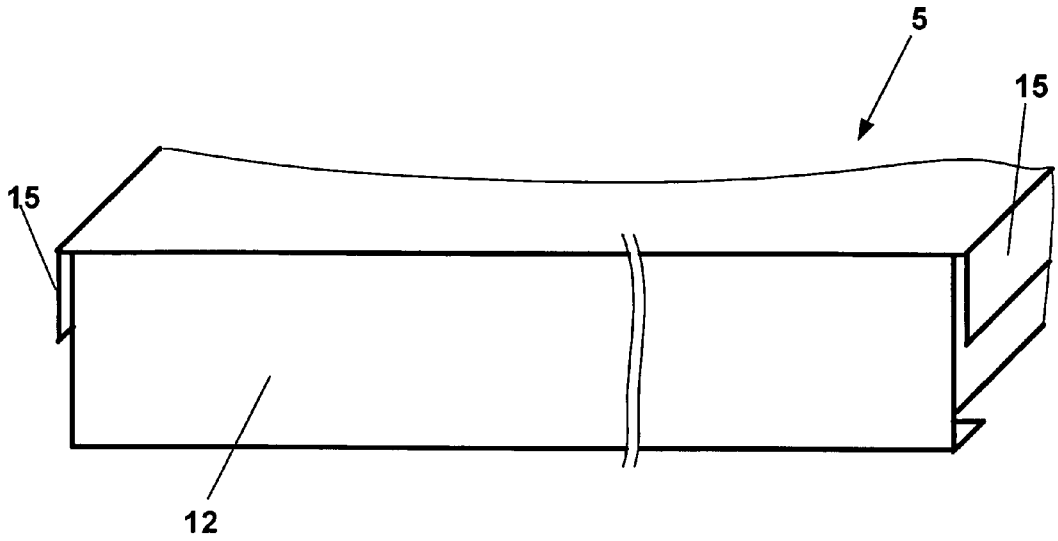
Figure 7:
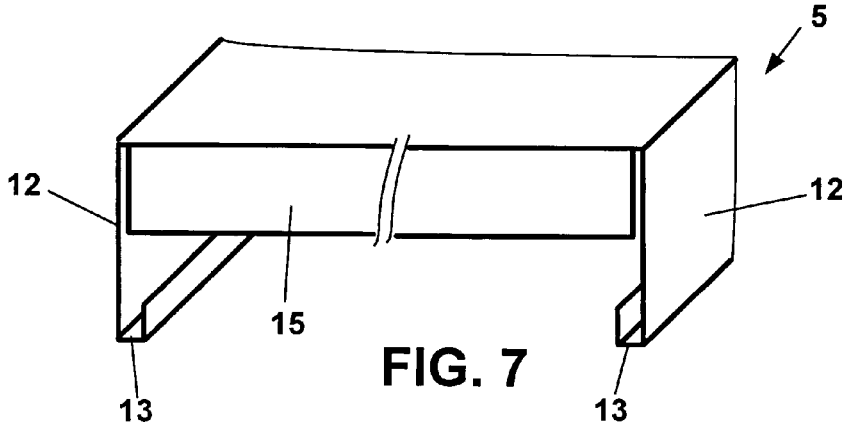
Figure 8:
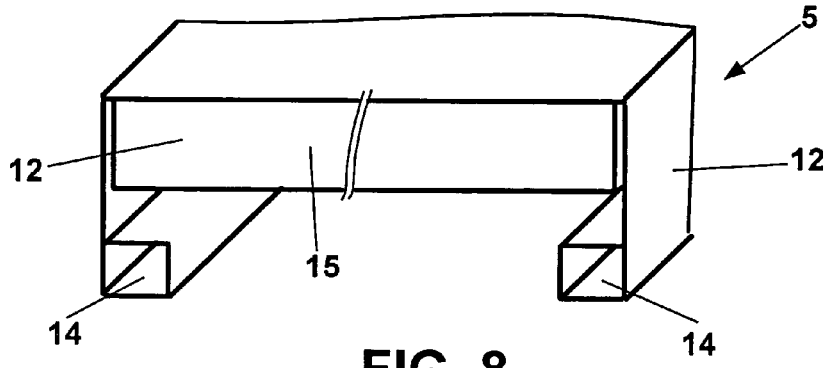
Figure 9:
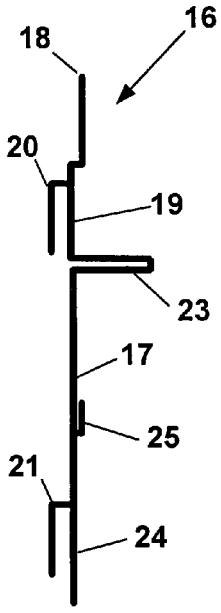

FIG. 6 shows a perspective side view and FIGS. 7 and 8 show two different perspective front side views of a supporting board 5. An articulate or adjoining descending side wall 12 is articulated on each of the sides of the supporting boards 5. The lower free end of the side wall 12 has a folded edge 13 in the form of a groove, as shown in FIG. 7, or a channel 14 closed at its side, according to FIG. 8.

A descending front side flap 15 is articulated, with a height corresponding approximately to the half height of the lateral wall 12. The supporting board 5 is provided for the jamming fixation of its frontal sections between the longitudinal poles 2 of shelf I and girders, which will be subsequently described.

FIGS. 9 through 12 show different views of a girder or crosspiece 16 for a shelf 1 in its first version, which is being used between two distanced longitudinal poles 2, frontally disposed in the shelf 1.

Girder 16 possesses a basic structural component 17 with an upper horizontal supporting edge 18, upon which rests the underside or inferior section, in the inserted condition, of the supporting board 5. Additionally, in the basic structural component 17 of girder 16, a bead 19 is formed. This features approximately the height of the front side flap 15 of said supporting board 5 and, in the introduced condition of the supporting board 5, is placed below its front side flap 15, and said front side flap 15 embraces, according to FIG. 10, the supporting edge 18 and the upper segment of the basic structural component 17, above said bead 19.

Figure 11:
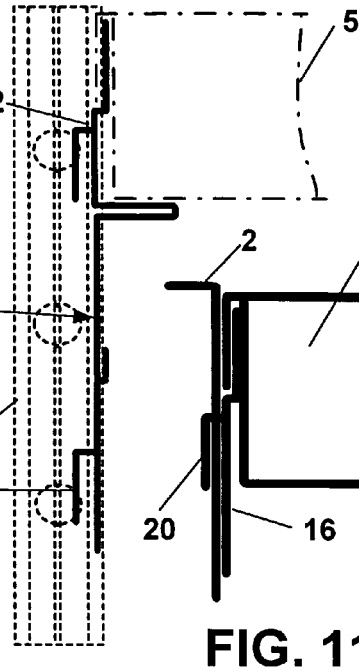
Figure 11A:
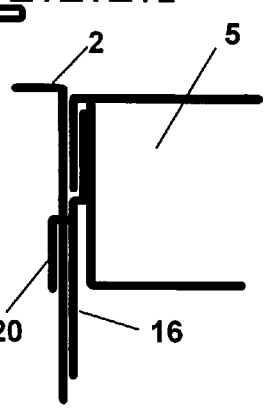
Figure 12:
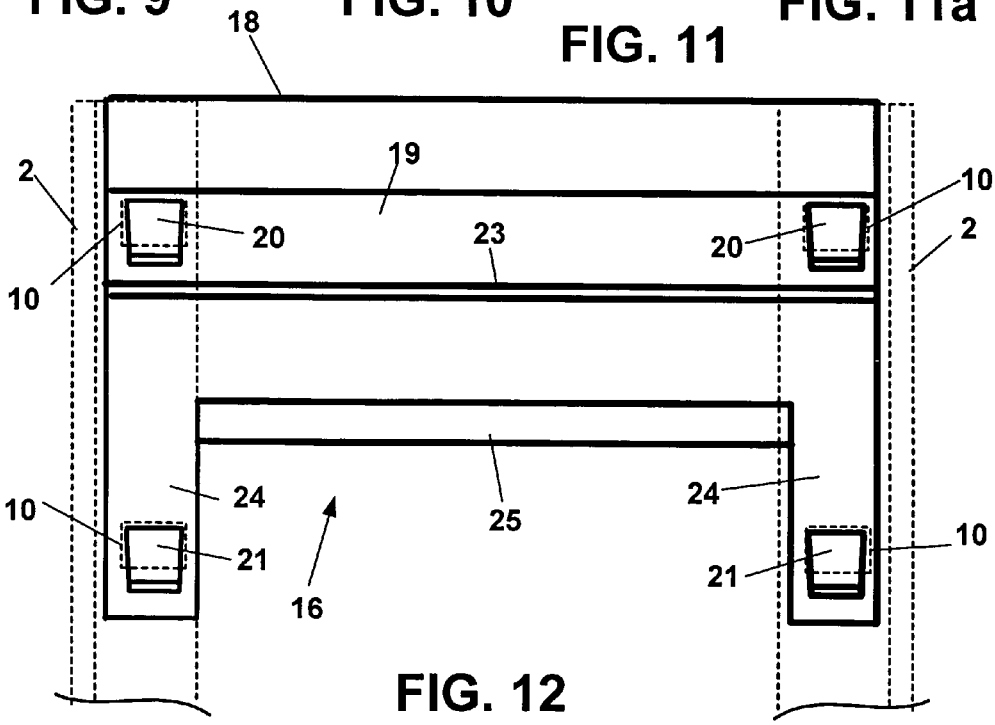

In the area of bead 19, in the marginal segments of girder 16, a pair of horizontally, reciprocally distanced upper hooks 20 is formed, as shown in FIG. 12. Also, in the lower area of the marginal segments, another pair of lower hooks 21 is formed. Upper and lower hooks 20, 21—according to FIG. 11—extend in the direction of the longitudinal poles 2 of shelf 1. The upper and lower hooks 20, 21 penetrate in the gaps 10 of longitudinal poles 2, according to FIG. 3. The front side flap 15 of the supporting board 5 is thus firmly jammed between girder 16 and longitudinal poles 2, and the lower and upper hooks 20, 21 of girder 16 provide a firm contact pressure at the longitudinal pole 2. This can be seen in the enlarged partial view according to FIG. 11*a* of the supper segment of the jammed connection according to FIG. 11. The free edge of the front side flap 15 of the supporting board 5 above the suspension points 22 of the upper hooks 20 of girder 16 extends into the longitudinal poles 2.

Figure 10:
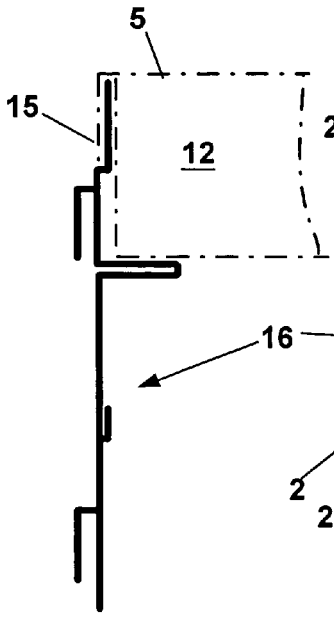

Furthermore, at the basic structural component 17 of girder 16, an additional support 23 is formed for the terminal sections of the longitudinal lateral walls 12 of the supporting board 5, horizontally disposed below the suspension points 22 of the upper hooks 20 of said girder 16. To form the additional support 23, the basic structural component 17 is folded in this area. As shown in FIG. 10 and 11, the end segments of the longitudinal side walls 12 of the supporting board 5—in its inserted condition —are located upon the support 23, so that the supporting board 5 is additionally supported. Also, the mid section of the basic structural component 17 of girder 16 is cut out between the pair of lower hooks 21, so that these hooks 21 are located in descending extensions 24 of girder 16. Between these units, a horizontally disposed and folded reinforcing edge 25 is formed, which additionally stabilizes girder 16.

Figure 13:
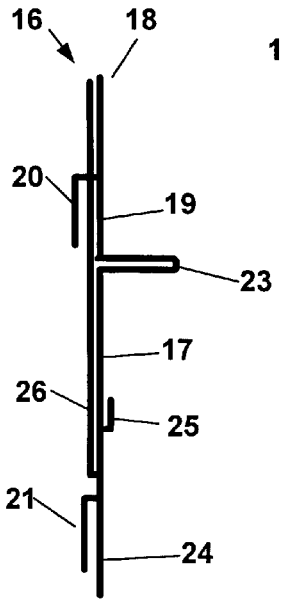
Figure 14:
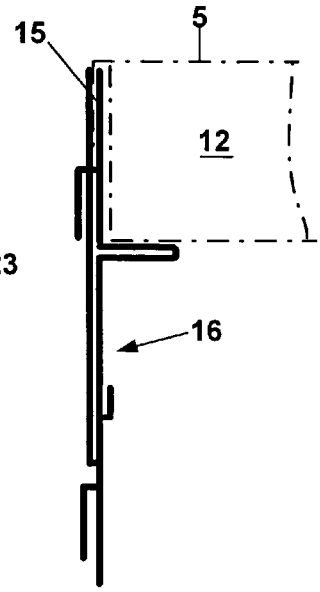
Figure 15:
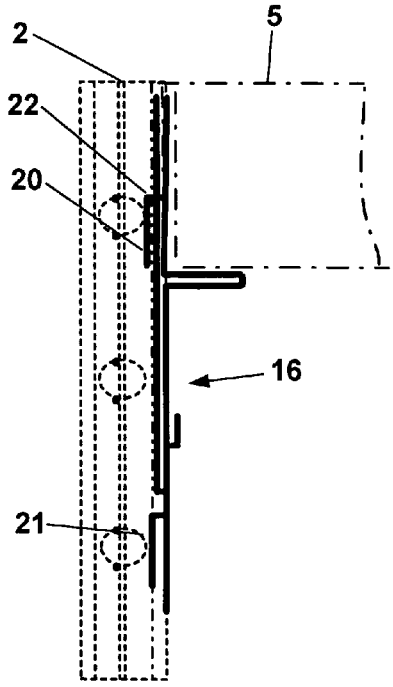

The modified version of girder 16 according to FIGS. 13 through 15 is different from the girder 16, shown in FIGS. 9 through 12, due to the fact that they feature on the side directed towards the longitudinal pole 2, an additional ascending, pocket-like folded edge 26. This is joined to the basic structural component 17. The upper edge of the pocket-like folded edge 26 is located in the same plane with the supporting edge 18 for supporting board 5. It covers the front section of the supporting board and simultaneously reinforces said girder 16.

In addition, the configuration of bead 19 was dispensed with, which is not absolutely necessary. Instead, for example, the pair of upper hooks 20 could feature a larger hook depth than the pair of the lower hooks 21, since in the gap between the pocket-like folded edge 26 and the basic structural component 17, the front side flap 15 of the supporting board 5 is inserted.

The pocket-like folded edge 26 may be formed in an ascending extended fashion in its upper marginal section or may have orifices to receive ascending plastic plugs or distancing elements, in order to protect against falling, for example, of files and other spacious vertical stored objects in the overlying drawer or shelf.

Figure 16:
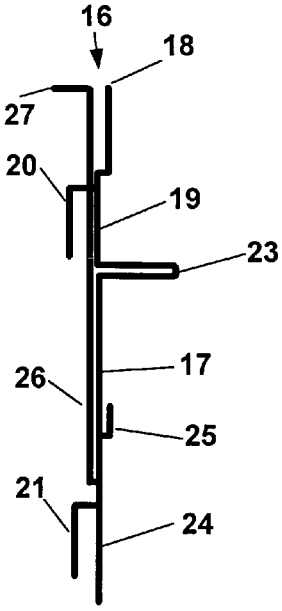
Figure 17:
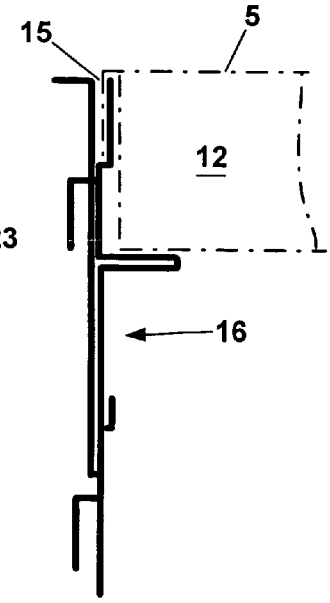
Figure 18:
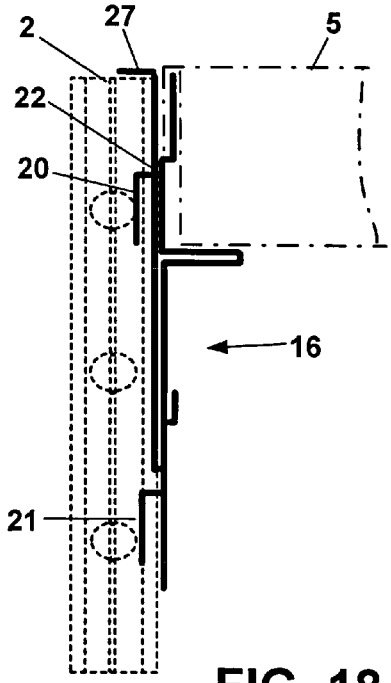
Figure 19:
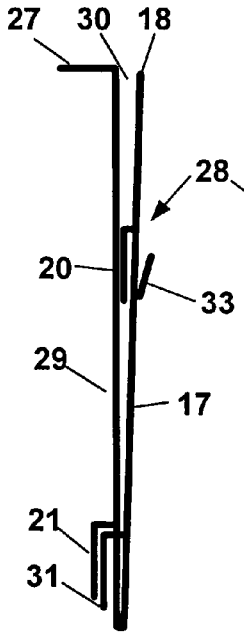

Another modification of girder 16, shown in FIGS. 9 through 12, is featured in girder 16, shown in FIGS. 16 through 18. In this case, the additional folded edge 26 has, at its upper end, a horizontal leg 27. This leg is designed to wholly or partially cover the upper front face of the longitudinal poles 2, to protect them, for example, against dirt or penetration of humidity and to provide an additional aesthetical appearance.

Another version of a girder or crosspiece 28 for said shelf 1 is represented in FIGS. 19 through 22. As long as similar references are used as regards girder 16 above described, the corresponding description details are also applicable to girder 28, so that repetitions may be avoided.

Figure 20:
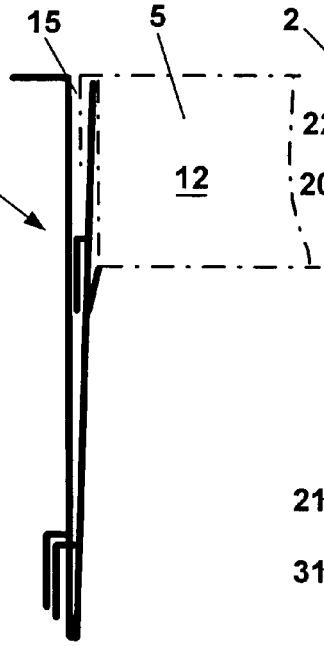

Girder 28 features a basic structural component 17 with a wall 29 joined to its lower section and propped up or resting against the basic structural component 17. A reception pocket 30 is thus being formed, which, in assembled condition, according to FIG. 20, is penetrated by the front side flap 15 of supporting board 5. In a similar way as with regard to girder 16 according to FIGS. 9 through 18, girder 28 has at the basic structural component 17 an upper pair of hooks 22, as well as a lower pair of hooks 21, which fulfill the same function as at girder 16. In addition, wall 29 propped up against the basic structural component 17, has an additional lower pair of hooks 31, which are congruent and propped against the lower pair of hooks 21 at the basic structural component 17. Both pairs of lower hooks 21 and 31 penetrate jointly into the gaps 10 formed within the longitudinal poles 2, which are adjusted to the format of hooks 20,21,31. In order to enable a penetration of the upper pair of hooks 20 with the longitudinal poles 2 beyond the wall 29, the wall 29 of girder 28, propped up against the basic structural component 17, in its corner sections, possesses releases 32 above the lower pair of hooks 31. The upper pair of hooks 20 is thus being liberated in the basic structural component 17. For an improved representation, the area of the basic structural component 17, visible through the releases 32, is represented with dotted lines. Consequently, this view shows the wall 29, which partially covers the basic structural component 17.

Figure 21:
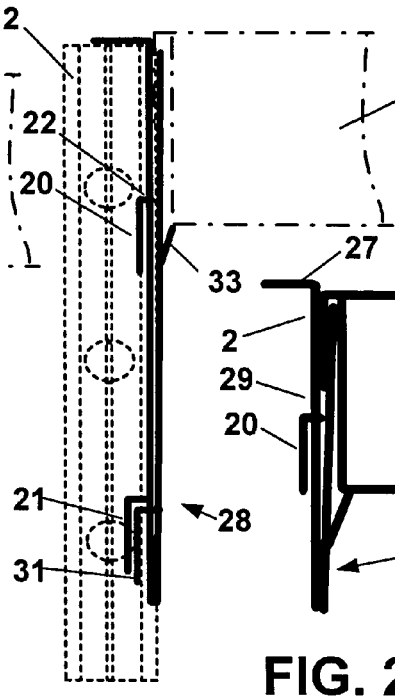
Figure 21A:
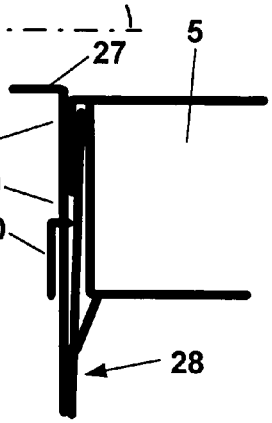
Figure 22:
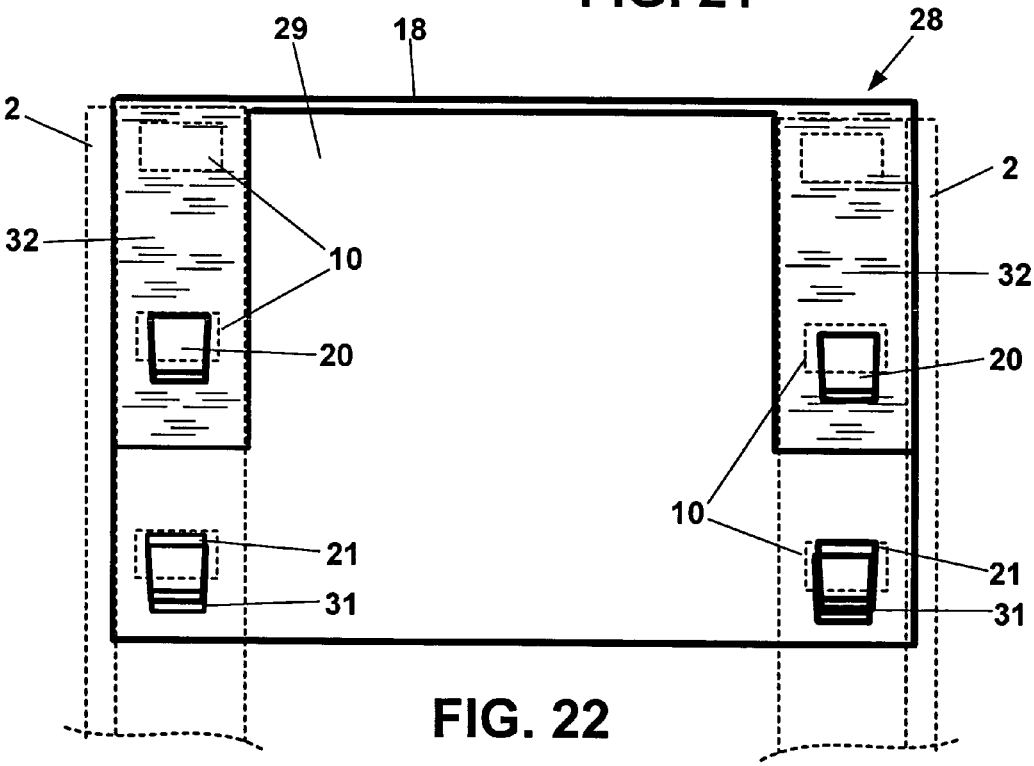

FIG. 21*a* shows an enlarged partial view of the upper section of the jammed connection according to FIG. 21. With the assembled jammed connection of supporting board 5, girder 28 and longitudinal pole 2, the basic structural component 17 and wall 29 propped up against it, are being reciprocally compressed. The front side flap 15 of the supporting board 5 is received in the reception pocket 30 of girder 28, and is thus being jammed between girder 28 and longitudinal pole 2, being firmly retained. Also with this version, the free edge of the front side flap 15 of supporting board 5 above the suspension points 22 of the upper hooks 20 of girder 28, extends into the longitudinal poles 2.

On the side distant from longitudinal pole 2, a protuberance 33 is formed at the basic structural component 17 of girder 28. Upon this protuberance rest the terminal sections of the longitudinal side walls 12 of the supporting board 5 and are supported by said protuberance 33.

The wall 29 of the girder 28, joined at the basic structural component 17, may be formed extended in ascending direction or may feature orifices to receive ascending plastic plugs or distancing elements, in order to protect files and other stored spacious vertical objects in the overlying shelf against falling.

Girder 28, according to FIGS. 23 through 27, has a basic structural component 17 with a wall 29 joined on its lower section by folding and propped up against the basic structural component 17. A reception pocket 30 is thus being formed, into which penetrates, in assembled condition according to FIG. 24, the front side flap 15 of the supporting board 5. At the basic structural component 17, girder 28 has an upper pair of hooks 20, as well as a lower pair of hooks 31, which are distanced from each other both in horizontal as well as in vertical direction.

Wall 29, joined at basic structural component 17, has gaps or recesses 34 which are congruent to the hooks 20,31, formed at the basic structural component 17. The vertical distance of hooks 20,31 at the basic structural component and the corresponding congruent gaps 34 at wall 29 are determined by the distance of gaps 10 at the longitudinal poles 2 of said shelf.

Both pairs of upper and lower hooks 20 and 31 of the basic structural component 17 thus penetrate, according to FIGS. 23 through 27, into the gaps 34 at wall 29 and into the gaps 10, formed at longitudinal poles 2.

Figure 27:
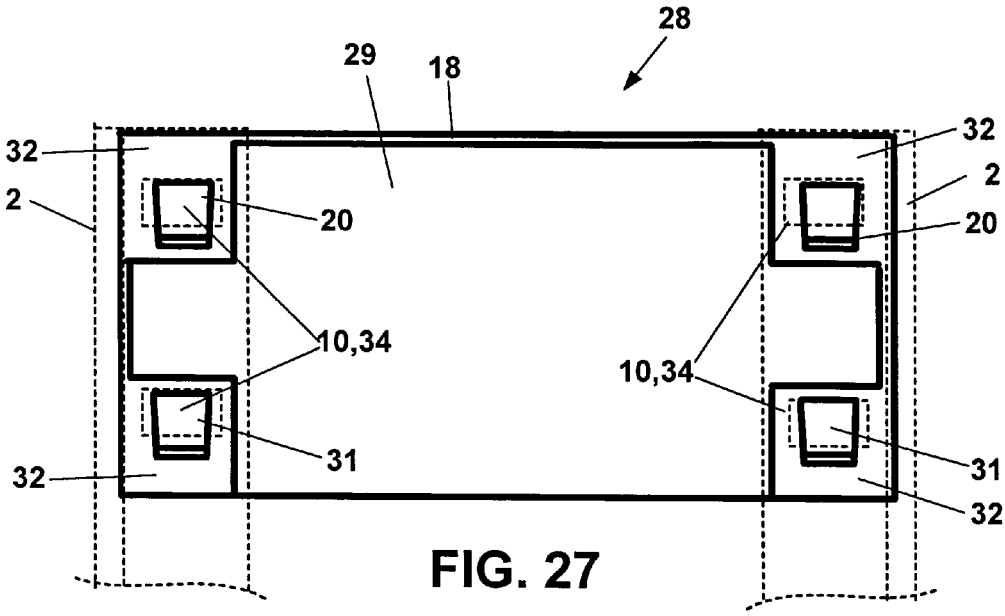

For reasons of economy of material and better production possibility of the folded section between the basic structural component 17 and wall 29 joined thereto, wall 29 of girder 28, propped up against the basic structural component 17, according to FIG. 27, features releases 32 in its upper and lower corner sections. The segments of wall 29, remaining between releases 32, are designed to provide stiffness to girder 28.

Figures 23, 24, 25, 25A:
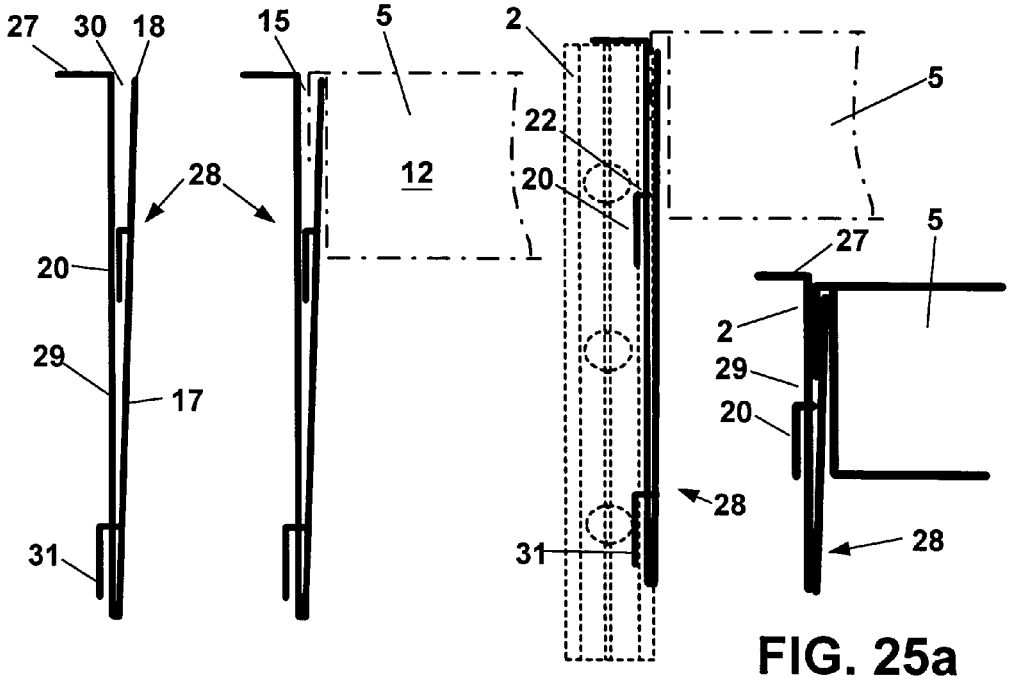
Figure 26:
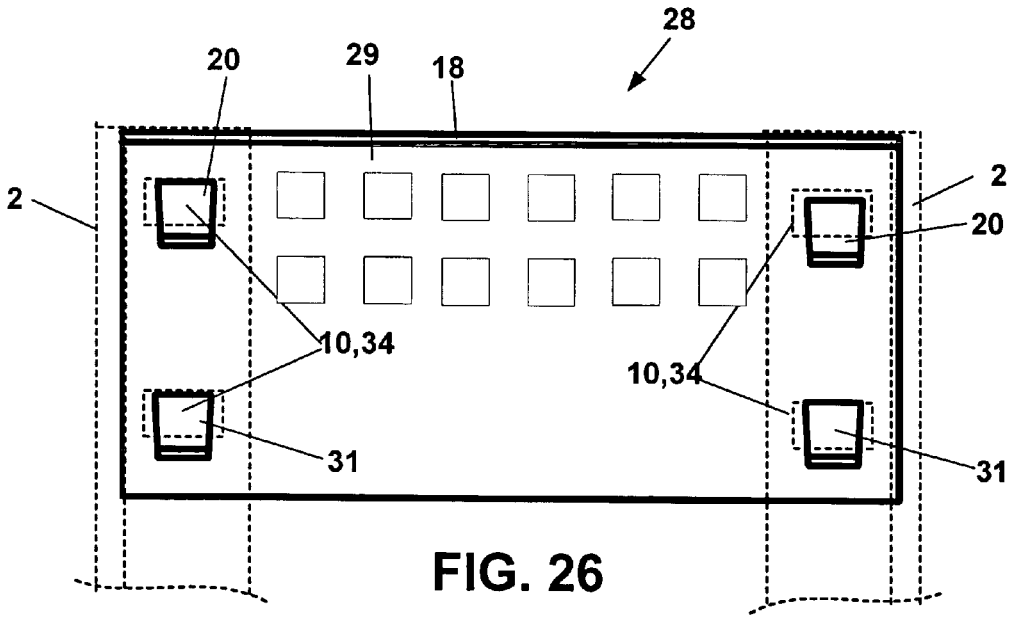

FIG. 25*a* features an enlarged partial view of the upper segment of jammed connection according to FIG. 23. In the state of the jammed connection of supporting board 5, girder 28 and longitudinal pole 2, the basic structural component 17 and wall 29 joined thereto are compressed. In this case, the front side flap 15 of supporting board 5 is inserted in receiving pocket 30 of girder 28, and is thus jammed and firmly retained. The free edge of the front side flap 15 of the supporting board 5 extends into the longitudinal poles 2 above the suspension points 22 of the upper hooks 20 of girder 28.

At the basic structural component 17, girder 28 has an upper horizontal supporting edge 18, upon which, in the inserted condition of the supporting board 5, rests its lower side.

At the upper edge of wall joined to the basic structural component 17, a horizontal leg 27 is provided. This is designed to wholly or partially cover the upper front face of longitudinal poles 2, in order to protect same, for example, against dirt or penetration of humidity and to provide an aesthetic appearance. Openings not represented may be inserted into this leg 27, which may receive for example, rubber plugs, plastic plugs, distancing elements or other ascending fitting elements, in order to prevent falling of vertically stored files, for example, in the overlying shelf.

Furthermore, the girder has two parallel horizontally extending rows of square holes 36, into which product sustaining elements, not shown, such as hooks, supporting plates, suspension angles and similar items may be suspended.

Figure 28:
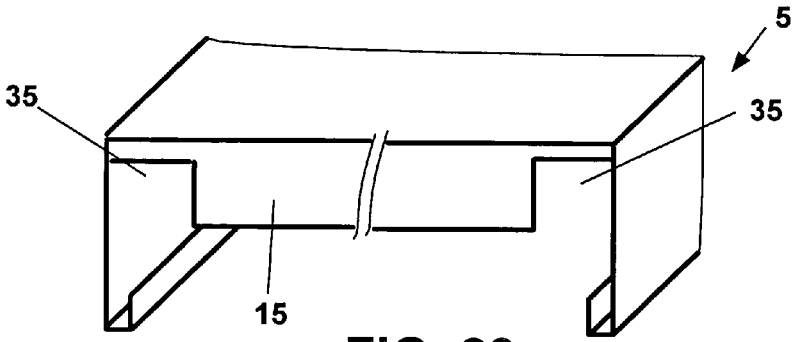

Supporting board 5, according to FIG. 28, has releases 35 at its front side flaps 15. The remaining segment of each front side flap 15, in the assembled condition of the girder 28, is located between its basic structural component 17 and wall 29 propped up against it. While front side flap 15, in its corner sections, is not directly jammed with the front side flap 15, this jammed connection takes place between girder 28 and longitudinal poles 2.

The specification incorporates by reference the disclosure of German priority documents 101 48 174.8 filed Sep. 28, 2001, 101 60 364.9 filed Dec. 8, 2001 and PCT/EP02/10401 filed Sep. 17, 2002.

The present invention is, of course, in no way restricted to the specific disclosure of the specification and drawings, but also encompasses any modifications within the scope of the appended claims.

REFERENCE NUMERAL LIST

1 shelf
2 longitudinal pole
3 foot
4 strut
5 supporting board
6 gap
7 fissure
8 perforation
9 perforation
10 gap
11 fissure
12 (longitudinal) side wall
13 folded section
14 channel
15 front side flap
16 girder
17 basic structural component
18 supporting edge
19 bead
20 upper hooks
21 lower hooks
22 suspension point
23 additional support
24 extension
25 reinforcing edge
26 pocket-like folded edge
27 leg
28 girder
29 wall
30 reception pocket
31 lower hooks
32 release
33 protuberance
34 gap
35 release
36 orifice.

The invention claimed is:

1. A shelf system for storage and filing of objects, comprising:

at least one shelf unit having a quadrilateral cross-sectional configuration;

vertical longitudinal posts disposed at corners of said shelf unit;

horizontal crosspieces disposable between two front ones of said posts, wherein said crosspieces are provided with vertically and horizontally spaced-apart, downwardly directed pairs of hooks, and wherein said posts are provided with recesses for receiving said hooks of said crosspieces, wherein the hooks penetrate into said recesses of said posts; and supporting boards respectively provided with a downwardly directed front flap, wherein said flaps are adapted to be firmly wedged between said crosspieces and the posts that receive them to prevent lifting of said supporting boards, wherein the hooks are adapted to provide a firm contact pressure of the flaps at the posts, and wherein said crosspieces are comprised of a basic structural component that overlaps at least said front flap of said supporting board wherein said crosspiece is provided with a reinforcing member in which are formed at least upper ones of said hooks, and wherein said crosspiece is provided with a reinforcing edge between said posts.

2. A shelf system according to claim 1, wherein for an underside of a supporting board, each of said crosspieces is provided with a supporting edge that extends above an upper one of said pairs of hooks, wherein each of said hooks has a suspension point, wherein each said suspension point is the position at which each of said hooks is inserted in the crosspiece, and wherein a free edge of said flap of said supporting board extends above the suspension point of said upper hooks of said crosspiece, in said posts.

3. A shelf system according to claim 2, wherein a height of said flap of said supporting board corresponds approximately to a distance between said supporting edge and said suspension point of said upper hooks of said crosspiece.

4. A shelf system according to claim 2, wherein said crosspiece, on a side directed toward said posts, is additionally provided with an upwardly directed, pocket-shaped turned-up portion, an upper edge of which is disposed in a plane with said supporting edge for said supporting board.

5. A shelf system according to claim 4, wherein said upper edge of said turned-up portion is provided with a horizontal leg for a complete or partial overlapping of upper end faces of said posts.

6. A shelf system according to claim 4, wherein said upwardly directed pocket-shaped turned-up portion of said crosspiece 16 extends beyond said supporting edge thereof.

7. A shelf system according to claim 2, wherein said supporting edge of said crosspiece is provided with stamped material portions or additional insertion elements to overlap transition areas between adjacent supporting boards.

8. A shelf system according to claim 1, wherein said crosspiece comprises a basic structural component and is provided with an additional support for end portions of side walls of said supporting board.

9. A shelf system according to claim 8, wherein said additional support has a horizontal orientation, and is preferably disposed below said suspension points of said upper hooks of said cross piece.

10. A shelf system according to claim 1, wherein said crosspiece is comprised of a basic structural component having a wall that is joined to an underside of said basic structural component and rests thereagainst, thereby forming a receiving pocket for said front flap of said supporting board.

11. A shelf system according to claim 10, wherein said basic structural component of said crosspiece is provided with upper and lower ones of said pairs of hooks, and wherein said wall of said basic structural component has a lower pair of further hooks that are aligned with and rest against the lower pair of hooks in said basic structural component.

12. A shelf system according to claim 11, wherein corner regions of said wall of said basic structural component are provided with releases above the lower pair of further hooks to release the upper pair of hooks in said basic structural component.

13. A shelf system according to claim 10, wherein said basic structural component of said crosspiece has a height that overlaps at least said front flap of said supporting board.

14. A shelf system according to claim 10, wherein a side of said crosspiece 28 directed away from said posts is provided with projecting elements for a support of end portions of side walls of said supporting board.

15. A shelf system according to claim 14, wherein said projecting elements are separate components, preferably thrust blocks, that are connectable to said crosspiece.

16. A shelf system according to claim 10, wherein an upper end of said wall of said basic structural component is provided with a horizontal leg for a complete or partial overlapping of upper end faces of said posts.

17. A shelf system according to claim 1, wherein said hooks of said crosspieces have different hook depths.

18. A shelf system according to claim 1, wherein said crosspiece comprises a basic structural component that is embodied in a downwardly extended manner.

19. A shelf system according to claim 1, wherein said crosspiece comprises a cut to size piece.

20. A shelf system according to claim 1, wherein said crosspiece comprises a basic structural component having a wall that joins an underside thereof and rests against said basic structural component to form a receiving pocket for said front flap of said supporting board, and wherein said downwardly directed flap of said supporting board is adapted to be wedged in said receiving pocket of said crosspiece comprised of said basic structural component 17 and said wall 29 that rests thereagainst.

21. A shelf system according to claim 20, wherein said basic structural component of said crosspiece is provided with a pair of upper hooks and a pair of lower hooks, and wherein said wall that rests against said basic structural component is provided with recesses that are aligned with said hooks.

22. A shelf system according to claim 20, wherein said wall that rests against said basic structural component is provided in upper and/or lower corner regions with releases to release said upper and lower hooks in said basic structural component.

23. A shelf system according to claim 1, wherein said crosspiece is provided with at least one horizontal row of holes for an insertion of product-supporting elements.

* * * * *